US005634635A

United States Patent [19]

Kobayashi et al.

[11] Patent Number: 5,634,635

[45] Date of Patent: Jun. 3, 1997

[54] AUTOMATIC DOCUMENT FEEDER

[75] Inventors: Atsumi Kobayashi; Mamoru Akiyama; Hiroshi Mukouyama, all of Yamanashi-ken, Japan

[73] Assignee: NISCA Corporation, Yamanashi-ken, Japan

[21] Appl. No.: 519,549

[22] Filed: Aug. 25, 1995

[30] Foreign Application Priority Data

Aug. 26, 1994 [JP] Japan ..... 6-335186
Aug. 26, 1994 [JP] Japan ..... 6-335187

[51] Int. Cl.[6] ..... B65H 5/22

[52] U.S. Cl. ..... 271/3.16; 271/3.21; 271/3.17; 271/4.02; 271/4.03; 271/4.1; 271/10.02; 271/10.04; 271/10.12; 271/10.13; 271/242; 271/270; 271/902

[58] Field of Search ..... 271/3.15, 3.21, 271/3.17, 3.18, 4.02, 4.03, 4.09, 4.1, 10.02, 10.03, 10.04, 10.1, 10.11, 10.12, 10.13, 242, 176, 270, 902

[56] References Cited

U.S. PATENT DOCUMENTS

| | | | |
|---|---|---|---|
| 4,548,394 | 10/1985 | Koyama et al. | 271/10.02 |
| 4,579,327 | 4/1986 | Furuichi | 271/270 |
| 4,667,951 | 5/1987 | Honjo et al. | 271/270 |
| 4,721,297 | 1/1988 | Katayama | 271/242 |
| 4,761,001 | 8/1988 | Hayakawa et al. | 271/902 |
| 5,154,412 | 10/1992 | Iseda | 271/242 |
| 5,320,339 | 6/1994 | Thomas et al. | 271/902 |

FOREIGN PATENT DOCUMENTS

| | | | |
|---|---|---|---|
| 403264430 | 11/1991 | Japan | 271/10.13 |

OTHER PUBLICATIONS

Japanese Patent Application Publication No. SHO 53-102752(A) Jul. 9, 1978.

Japanese Patent Application Publication No. SHO 61-295946(A) Dec. 26, 1986.

Japanese Patent Application Publication No. HEI 1-127557(A) May 19, 1989.

Japanese U.M. Application Publication No. SHO 58-34128(A) May 3, 1983 English abstract not enclosed.

*Primary Examiner*—H. Grant Skaggs
*Attorney, Agent, or Firm*—Kane, Dalsimer, Sullivan, Kurucz, Levy, Eisele and Richard, LLP

[57] ABSTRACT

An automatic document feeder for feeding and discharging a document or documents to and from a document handling device such as a copying machine includes a document supply unit having a separation roller and register rollers, positioning unit and discharge unit, which are driven by a drive unit having a single reversible driving motor. The separation roller is operated to forward the document to a document reading portion when driving the driving motor in a first direction, and stopped when driving the driving motor in a second direction. The register rollers are operated only when driving the driving motor in a second direction. By slowing down the separation roller just before the document collides with the register rollers, the document can be transferred at high speed without being damaged.

16 Claims, 8 Drawing Sheets

AUTOMATIC DOCUMENT FEEDER

BACKGROUND OF THE INVENTION

1. Field of the Invention

This invention relates to an automatic document feeder operable with one driving means, and more particularly to a document feeder capable of automatically feeding original documents to be treated one by one to a document handling device such as a copying machine at high speed with a high efficiency by using only a single motor.

2. Description of the Prior Art

There have been so far proposed a variety of document feeders for automatically supplying and discharging original documents one by one to and from a document handling device such as an electrostatic copying machine, printer, image scanner and facsimile. Generally, the document feeder comprises a document supply unit for feeding out original documents one by one from a supply tray and transferring the original document to a document reading portion defined on the document handling device through a document supply passage, and a document discharge unit for sending out the document from the document reading portion to a discharge tray after treating the document. For instance, in the copying machine, the document feeder is pivotally laid on an upper surface with a platen of the machine, onto which the original document is supplied to optically read an image on the document.

The document feeders are grouped into two types, one having the document supply unit and document discharge unit which are opposed to each other astride the document reading portion, and other type having the document supply unit integrated with the document discharge unit on one side of the document reading portion. The automatic document feeders disclosed in U.S. Pat. Nos. 5,083,766; 5,280,330; 5,327,205 and 5,377,966 are typical of the former type. The document feeders of the latter type have been known by U.S. Pat. No. 4,922,292, Japanese Patent Application Public Disclosures Nos. SHO 61(1986)-295946(A) and HEI 1(1989)-127557(A), and Japanese Utility Model Public Disclosure No. SHO 58(1983)-34128(A).

The document feeder of the latter type having the united document supply and discharge units arranged on one side of the document reading portion can be made simple in structure and compact as schematically shown in FIG. 1 as one example.

As illustrated, this conventional document feeder comprises a document supply unit 1 for supplying an original document D1 to a document reading portion p2 defined on a platen P of a copying machine through a document supply passage p1, a document positioning unit 2 for transferring the document fed to the document reading portion p2 so as to place the tail end of the document D2 at a prescribed reading reference point X, and a document discharge unit 3 for sending out the document D3 from the document reading portion p2 via a document discharge passage p3 after copying.

The document supply unit 1 includes a document supply tray 1*a* for stacking the original documents thereon, a document separation means 1*b* for allowing only one document to pass therethrough, and paired register rollers 1*c* for performing skew correction of the document being forwarded through the document supply passage p1.

The document discharge unit 3 includes one or more discharge rollers 3*a* on the document discharge passage p3 so as to send out the document D2 from the document reading portion p2 to a document discharge tray 3*b*.

The document positioning unit 2 is formed of an endless belt with which the platen P is overlaid entirely or partially as proposed in U.S. Pat. No. 4,922,292. The document positioning unit 2 serves to not only place the document D2 at the reading position, but also feed out the document into the discharge passage p3 as indicated by D3.

In FIG. 1, reference numeral 4 denotes a gate member for aligning the tail end of the document D2 fed into the document reading portion p2 with the reading reference point X, and numeral 5 denotes a flap for switching over the document supply passage p1 and discharge passage p3 relative to the reading portion p2.

When feeding the original document D1 from the supply tray 1*a* to the document reading portion p2 through the document supply passage p1, the document separation means 1*b* is first driven to take out one original document D1 from the supply tray 1*a* and forward the document D1 to the register rollers 1*c*. To perform skew correction, the register rollers 1*c* are at a stop until the leading end of the document D1 comes into slight collision therewith and start to rotate to forward the document D1 to the reading portion p2 on the platen P immediately after the collision of the document with the register rollers. At this time, the gate member 4 assumes its lower position, and the switching flap 5 assumes its upper position so as to permit the document D1 to pass.

The document fed through the supply passage p1 is sent into the document reading portion p2 until the tail end of the document goes across the reading reference point X as indicated by D2 by driving the document positioning unit 2 in the forward direction d1. When the document D2 passes through the reading reference point X, the gate member 4 rises, and then, the document D2 is moved backward by driving the document positioning unit 2 in the reverse direction d2 until the tail end thereof collides with the gate member 4 so as to place the document D2 at the prescribed reading position on the platen P when the document D2 collides with the gate member 4, the document positioning unit 2 is stopped for carrying out the copying operation. Upon completion of copying, the gate member 4 and the switching flap 5 are lowered, and then, the document positioning unit 2 is driven in the reverse direction d2 to send out the document D2 from the document reading portion p2 to the document discharge passage p3.

Thus, in order to forward the document from the supply tray 1*a* to the document reading portion p2 through the supply passage p1 and further to the discharge tray 3*b* through the discharge passage p3, the separation means 1*b*, register rollers 1*c*, document positioning unit 2, and discharge rollers 3*a* must be operated by controlling exclusive driving motors independently with exquisite timing.

That is, at least three motors M1, M2 and M3 are required for driving the document supply unit 1, document positioning unit 2 and the document discharge unit 3, respectively as illustrated. In this mechanism, the separation means 1*b* and the register rollers 1*c* must be operated differentially, albeit by one motor M1, as touched upon above. Therefore, an electromagnetic clutch 6 is required for deactivating the register rollers 1*c* until the document forwarded by the separation means 1*a* collides with the register rollers.

Furthermore, the document feeder of this type calls for a plurality of driving means such as electric solenoid for operating the gate member 4 and the switching flap 5 in addition to the plurality of motors M1–M3 for driving the document supply unit 1, document positioning unit 2 and document discharge unit 3, and the electromagnetic clutch 6 provided to the register rollers 1*c*, resulting in a large overall size and complexity of the document feeder.

Moreover, recently, a need has been felt for a small and lightweight automatic document feeder capable of efficiently transferring the original document at high speed. Although the original document can be transferred fast even by speeding up the moving components in the document feeder, the document may possibly incur damage particularly when coming into collision with the register rollers and the gate member.

OBJECT OF THE INVENTION

This invention is made to eliminate the drawbacks suffered by the conventional document feeder as described above and has an object to provide a simple and rationally operable automatic document feeder applicable to a document handling device such as a copying machine, in which moving components incorporated in a document supply unit, document positioning unit and document discharge unit can be driven with only one driving means with a high efficiency.

Another object of the invention is to provide a high performance automatic document feeder capable of safely transferring original documents one by one in succession at high speed without inflicting any damage to the document being transferred.

Still another object of the invention is to provide an automatic document feeder capable of simultaneously transferring and discharging the documents existing different document passages at one time.

SUMMARY OF THE INVENTION

To attain the object described above according to this invention, there is provided an automatic document feeder comprising a document supply unit for feeding original documents one by one to a document reading portion, a document positioning unit disposed on the document reading portion, a document discharge unit for discharging the document from the document reading portion, and a drive unit including a reversible motor for driving the document supply unit, document positioning unit and document discharge unit.

The document supply unit has a document supply passage and is provided with a document separation means for allowing only one document to pass therethrough, and at least one pair of register rollers for performing skew correction of the document being forwarded. The document separation means is connected with the driving motor through an electromagnetic clutch so as to be selectively driven when operating the driving means in a first direction. The register rollers are connected with the driving motor through a one-way clutch for transmitting rotational motion of the driving motor to the register rollers when operating the driving motor in a second direction opposite to the first direction.

The document positioning unit includes document setting means for placing the document at a prescribed document reading position. The document setting means is operated in both directions of rotation of the driving motor.

The document discharge unit includes at least one document discharge roller which is connected with the driving motor through a one-way clutch so that the discharge roller rotates when driving the driving motor in the first direction.

Firstly, by driving the driving motor in the first direction, the document separation means in the document supply unit is operated to send out one document from a supply tray. At this time, the register rollers do not yet rotate. Just after the document being forwarded by the document separation means comes in contact with the register rollers, the driving motor is reversed and the electromagnetic clutch of the document separation means is disengaged, thus rotating the register rollers to forward the document to the document reading portion and stopping the document separation means.

Upon treating the document at the prescribed document reading position, the driving motor is again reversed to rotate in the first direction. Thus, the document setting means of the document positioning unit and the document discharge roller are driven in the direction in which the document is discharged from the document reading portion to a discharge tray.

Having the document feeder applied to a document handling device such as a copying machine, the document can be fed to the prescribed document reading position and discharged therefrom with only one driving motor. At the time that the document fed by the document separation means comes near the register rollers and that the document is placed at the prescribed reading position, the driving motor slows down to reduce the speed at which the document is moved, consequently reducing the shock which the document experiences when colliding with the separation means and being placed at the reading position.

Thus, according to the document feeder of the invention, the original document can be efficiently transferred at high speed without being damaged with only one driving motor.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The automatic document feeder according to this invention can be efficiently operated at high speed with a single driving means (motor) and is applicable to various types of document handling devices such as a facsimile and image scanner. The document feeder applied to a copying machine by way of example will be described below.

Figure 1:
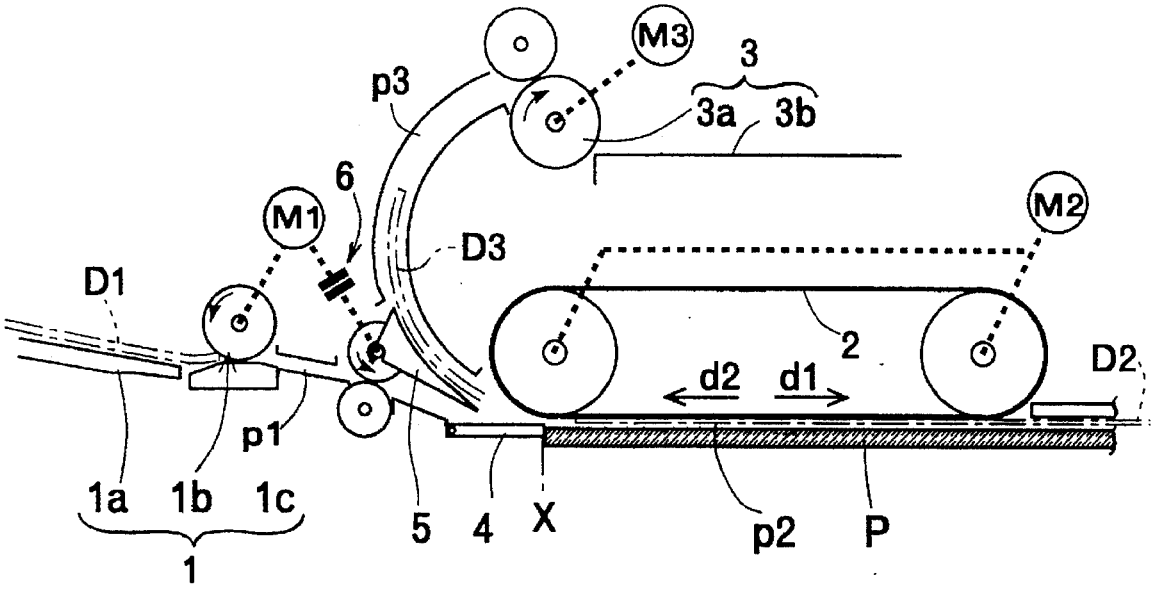
FIG. 1 Prior Art
FIG. 1 is a schematic side view showing one part of a prior art automatic document feeder.
Figure 2:
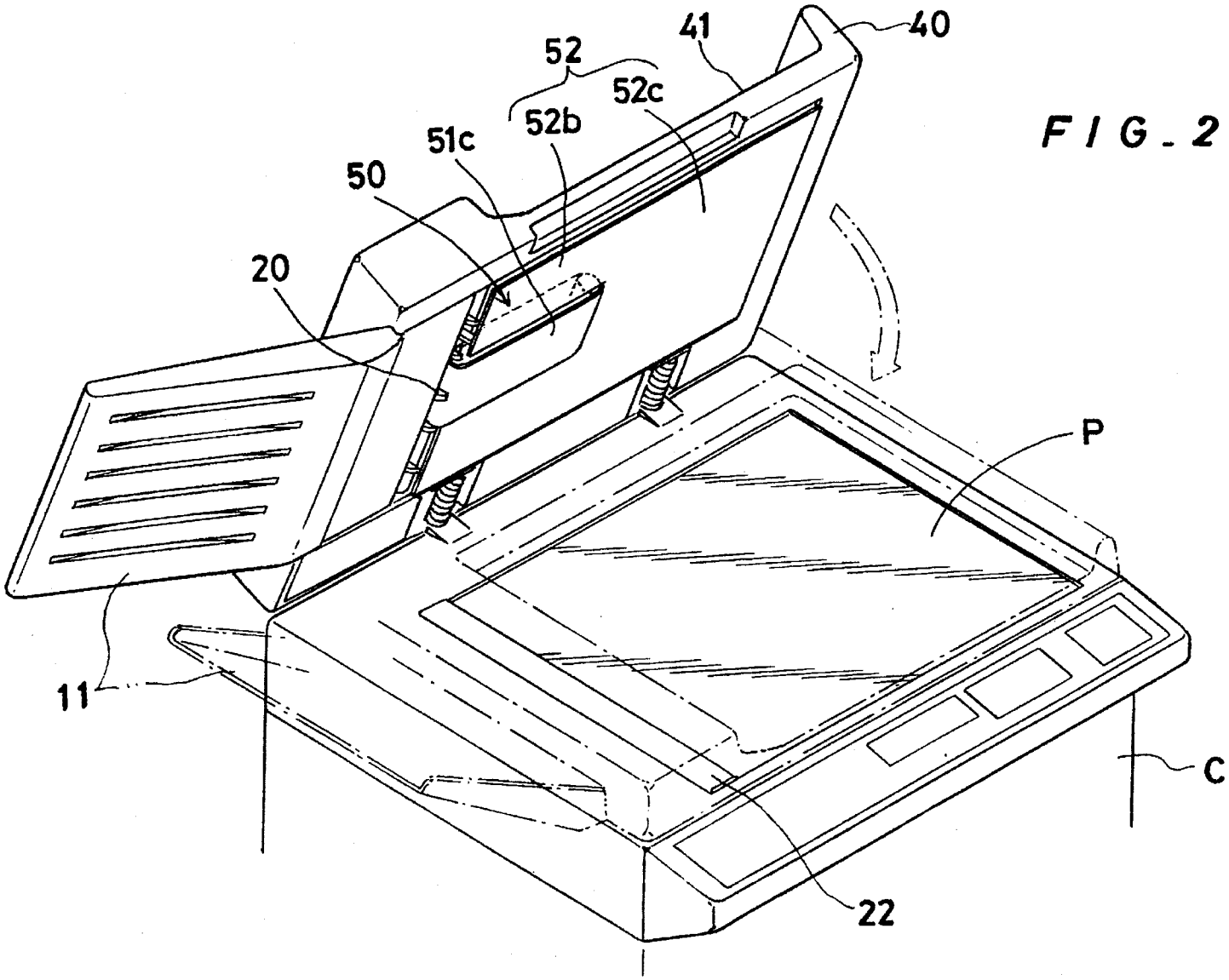
FIG. 2 is a schematic perspective view showing an automatic document feeder according to the present invention, applied to a copying machine.

As illustrated in FIG. 2, the document feeder of the invention is pivotally held on the copying machine C so as to openably overlay a platen P set in the upper surface of the machine C. That is, when automatically feeding the document, the document feeder is laid on the platen P as indicated by an imaginary line in the drawing, and when manually placing the document on the platen P, the document feeder is open as indicated by a solid line. On the platen P, a document reading portion is defined, at which an original document to be read optically or treated for copying is placed in position.

Figure 3:
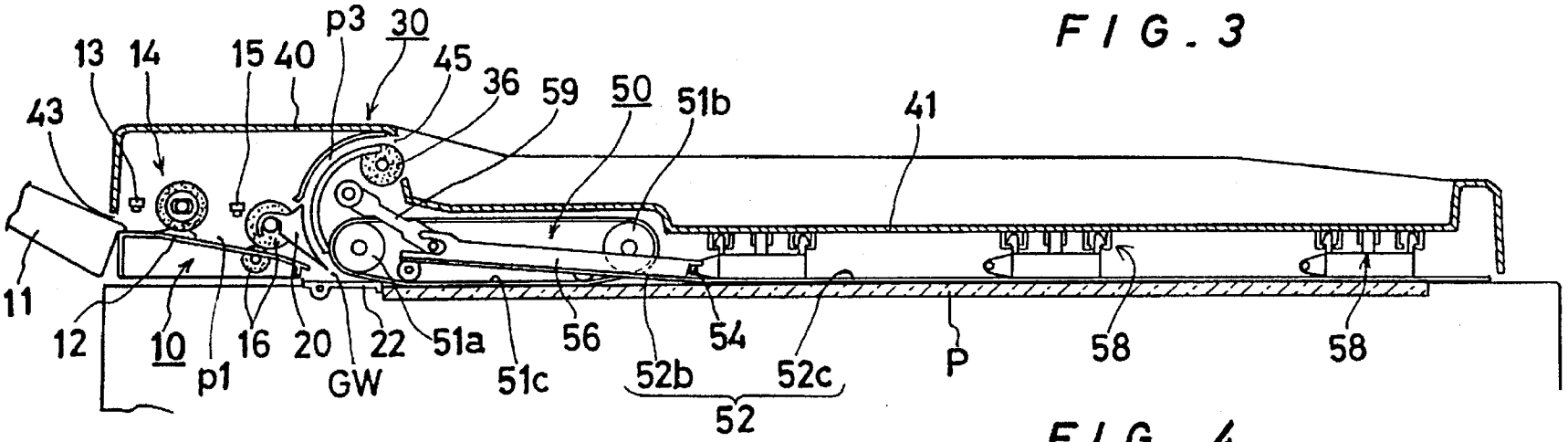
FIG. 3 is a side sectioned view schematically showing one embodiment of the document feeder of this invention.
Figure 4:
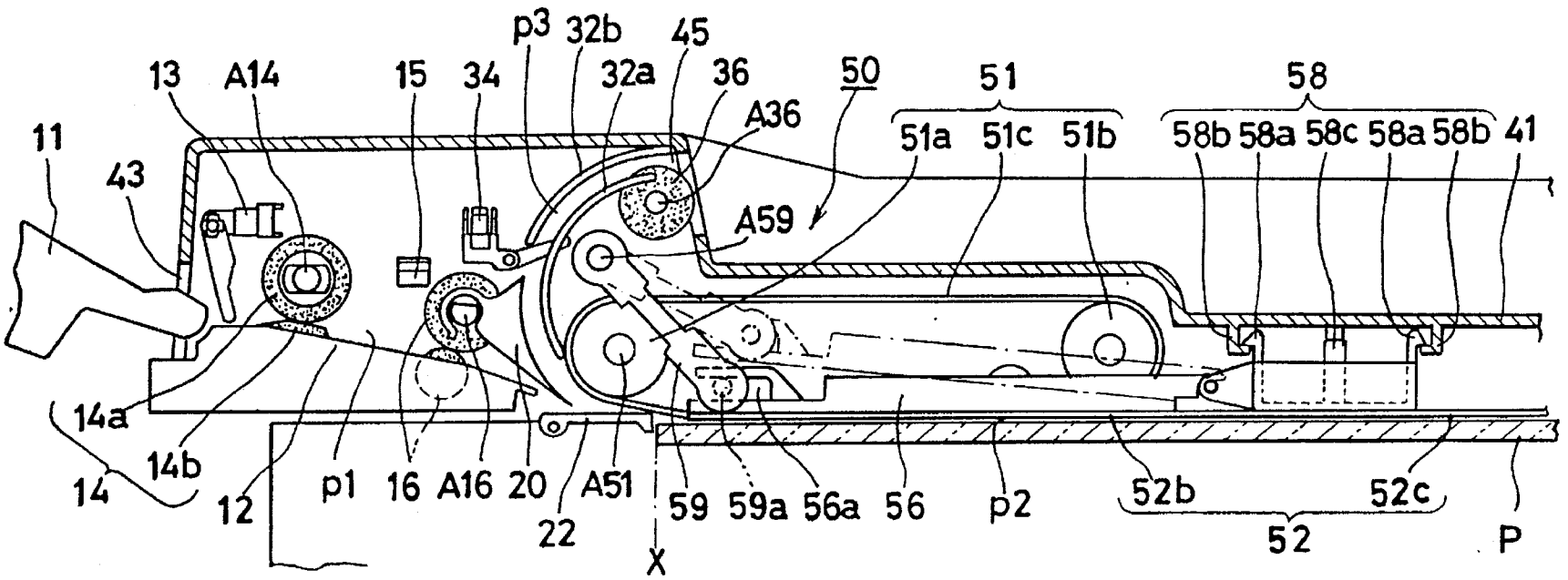
FIG. 4 is an enlarged side section schematically showing the principal portion of the feeder of FIG. 3.
Figure 5:
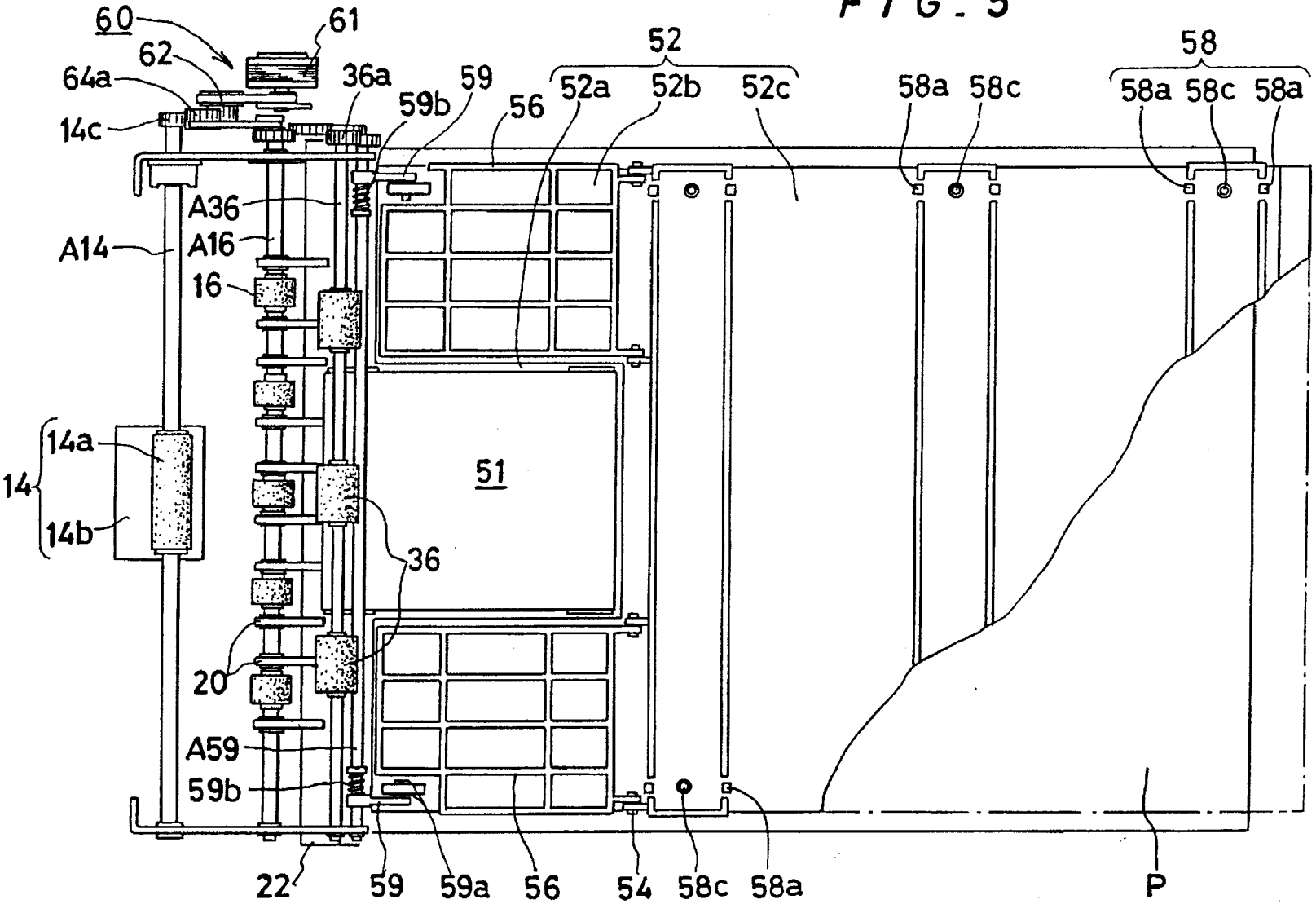
FIG. 5 is a schematic plane view of FIG. 3.

The document feeder of this invention comprises a document supply unit 10 for feeding original documents one by one to a document reading portion p2 on the platen P, a document positioning unit 50 disposed on the document reading portion, and a document discharge unit 30 for sending out the document from the document reading portion, as shown in FIG. 3. The document feeder further comprises a drive unit 60 including driving systems for the document supply unit 10, document positioning unit 50 and document discharge unit 30.

The document supply unit 10, document positioning unit 50, and document discharge unit 30 are contained in a housing 40 having a document discharge tray 41 located above the document reading portion p2 defined on the platen P, a document inlet 43 into which a document supply tray 11 for stacking the original documents is fitted, and a document outlet 45 confronting the discharge tray 41.

The document supply unit 10 is further provided with a document guide plate 12 for defining a document supply passage p1, a document sensor 13 for detecting the document or documents on the supply tray 11, a document separation means 14 for drawing one document from the documents stacked on the supply tray 11 and forwarding the drawn document toward the document reading portion p2, a register sensor 15 for detecting the document being forwarded via the separation means 14, and at least one pair of register rollers 16 for performing skew correction of the document fed from the separation means 14.

When the document sensor 13 detects the document or documents on the supply tray 11, the document feeder assumes its operable state.

The document separation means 14 is formed of a separation roller 14*a* and a friction pad 14*b* which come into frictional contact with each other. By rotating the separation roller 14*a*, the document being in contact with the separation roller 14*a* is forced toward the document reading portion p2, but the document or documents being out of contact with the separation roller 14*a* stay there. As a result, only one document is permitted to pass through the separation means 14.

At regular intervals of time after the register sensor 15 detects the leading end of the document passing through the document supply passage p1, the register rollers 16 start to rotate in opposite directions to each other to forward the document fed from the separation means 14. To be specific, the register rollers 16 are at a stop until the document collides with the nip portion between the register rollers 16. The document is slightly bent when its leading end collides with the register rollers 16, consequently directing the document to the exact forwarding direction, i.e. carrying out the skew correction of the document.

The system for operating the document supply unit 10 includes a drive shaft A14 for the separation roller 14*a*, and a drive shaft A16 for the register rollers 16.

The aforementioned document separation means 14 and register rollers 16 are not novel, and therefore, they should not be understood as limitative.

At a diverging point (gateway GW) among the document supply passage p1, reading portion p2 and discharge passage p3, there are disposed a switching flap 20 for switching over the document supply passage p1 and discharge passage p3 relative to the reading portion p2, and a gate member 22 for restraining the document at the document reading position X.

The switching flap 20 and gate member 22 are rockingly moved vertically by actuating exclusive electric solenoids, respectively. When introducing the document from the document supply passage p1 into the document reading portion p2, the switching flap 20 is shifted upward. When discharging the document from the document reading portion p2 to the discharge passage p3, the switching flap 20 is lowered.

The gate member 22 is operated for positioning the tail end of the document at the document reading reference point X.

The document positioning unit 50 comprises document setting means 51 with a driving wheel 51*a*, a driven wheel 51*b*, an endless belt 51*c* between the wheels 51*a* and 51*b*, and a document keep member 52. The document keep member 52 in this embodiment is formed in a substantially angular U-shape having a cut-out portion 52*a*, a rocking wings 52*b* and a rectangular stationary part 52*c*. The rocking wings 52*c* extend from the stationary part 52*c* on the either side of the cut-out portion 52*a*. When the document feeder is placed on the copying machine C, the platen P is entirely covered with the document setting means 51 disposed in the cut-out portion 52*a* and the document keep member 52.

The stationary part 52*c* is detachably attached to the underside of the discharge tray 41 by means of connectors 58 composed of hooks 58*a* planted on the stationary part 52*c*, and catch members 58*b* formed on the underside of the discharge tray 41 (housing 40) for retaining the hooks 58*a*. The connector 58 includes positioning means 58*c* for preventing the stationary part 52*c* from deviating horizontally from the housing 40.

Between the stationary part 52*c* and the platen P, a clearance is left for permitting the document to move under the stationary part 52*c*.

The rocking wings 52*b* are connected with the stationary part 52*c* rotatably around a rotary axis 54 and linked to at least one rocking linkage 59 through at least one pin 59*a*. By swiveling the rocking linkage 59, the rocking wings 52*b* are shifted upward for introducing or discharging the document into or from the document reading portion p2 defined on the platen P, or downward to press the document onto the platen when treating the document or reading the image on the document.

The system for operating the document positioning unit 50 comprehends a drive shaft A51 for the document setting means 51, and a drive shaft A59 for swiveling the rocking linkage 59.

The document discharge unit 30 includes guide members 32*a* and 32*b* between which the discharge passage p3 is defined, a document discharge sensor 34 for detecting the document being forwarded through the discharge passage p3, and at least one discharge roller 36 located at the document outlet 45 confronting the discharge tray 41.

The system for operating the document discharge unit 30 includes a drive shaft A36 for rotating the discharge roller 36.

Figure 6:
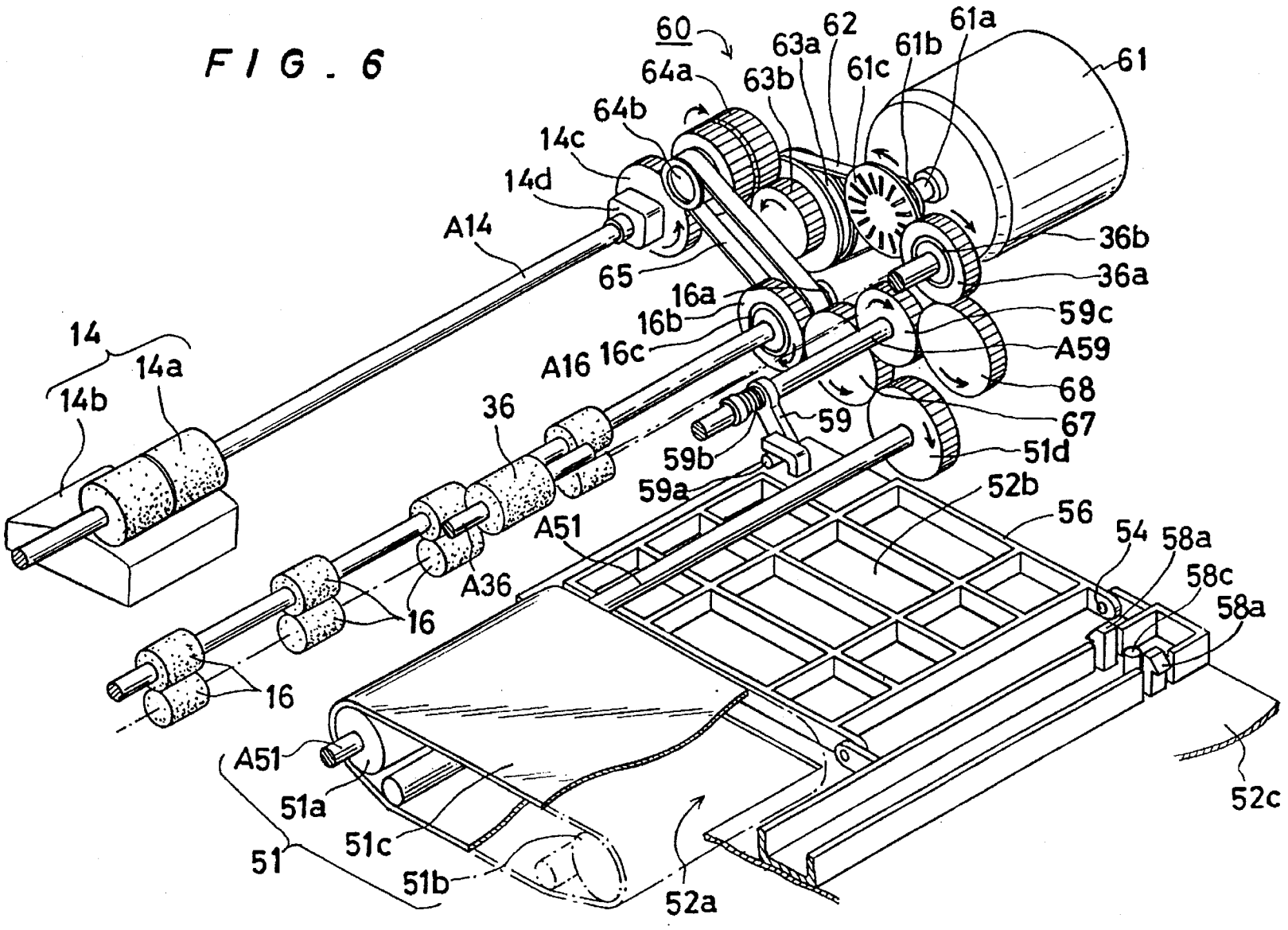
FIG. 6 is a partial perspective view explanatory of the driving system in the feeder of this invention.

The drive unit 60, which includes means for rotating the drive shaft A14 for the separation roller 14*a*, drive shaft A16 for the register roller 16, drive shaft A36 for the discharge roller 36, drive shaft A51 for the document setting means 51, and drive shaft A59 for the rocking linkage 59, is actuated by only one driving means (variable-speed reversible motor) 61 as shown in FIG. 6. That is to say, the document feeder of this invention can be rationally operated by controlling the direction of rotation and the rotational speed of the motor 61. Furthermore, even though a plurality of original documents exist in different passages, the documents can be effectively transferred and discharged simultaneously.

Referring to FIG. 6, the drive unit 60 which can fulfill the aforenoted peculiar functions of the invention will be described. In the illustrated embodiment, the directions of rotation of the respective rotating elements when rotating the reversible motor 61 in the positive direction (first rotational direction) are indicated conceptually by arrows.

The reversible motor 61 has a rotary shaft 61*a* with a drive pulley 61*b* and a rotary disc 61*c* for a rotary encoder. The rotary disc 61*c* has radial slits for generating timing pulses by use of a photocoupler (not shown) so as to determine the rotational angle of the rotary shaft 61*a* with a high degree of accuracy. The motor 61 may preferably be of a pulse motor or stepping motor capable of changing its rotational speed.

The rotational motion of the motor 61 is transmitted from the pulley 61*b* to a gear 64*a* through a belt 62, pulley 63*a* and a gear 63*b*.

The drive shaft A14 of the separation roller 14*a* is provided with a gear 14*c* engaged with the gear 64*a* and an electromagnetic clutch 14*d*, so that the separation roller 14*a* is selectively rotated when driving the motor 61 in the positive (first) direction as indicated by the arrow in FIG. 6, but halts when driving the motor 61 in the reverse direction (second rotational direction).

The rotational motion from the motor 61 is further transmitted to a gear 16*a* mounted on the drive shaft A16 for the register rollers 16 through a pulley 64*b*, belt 65, pulley 16*a*, and gear 16*b*. However, the gear 16*b* for the register rollers 16 incorporates a one-way clutch 16*c* for permitting the rotation of the motor in the reverse (second) direction to be transmitted to the register rollers 16, but preventing the rotation in the positive (first) direction from being transmitted to the register rollers 16. That is, the register rollers 16 are rotated only when driving the motor 61 in the reverse (second) direction.

The rotation of the motor 61 is further transmitted from the gear 16*b* to a gear 51*d* mounted on the drive shaft A51 for driving the document setting means 51 through a gear 67, so that the document setting means 51 is rotated in concert with the motor 61, but in the opposite direction to the motor 61. Namely, the setting means 51 is driven by the rotational motion in either direction of rotation of the motor 61.

A gear 59*a* mounted on the drive shaft A59 for swinging vertically the rocking wings 52*b* of the document keep member 52 is meshed with the gear 67, so that the linkage 59 is swiveled in concert with the motor 61 in the same direction as that in which the document setting means 51 is driven. The drive shaft A59 is connected with the linkage 59 through a friction clutch 59*b* formed of a slipping coil spring or the like, so as to prevent the linkage 59 from swiveling excessively.

The document discharge roller 36 is rotated in the direction of discharging the document to the discharge tray 41, when rotating the motor 61 in the positive (first) direction, by means of a gear 36*a* incorporating a one-way clutch 36*b* and is engaged with the gear 59*a* via a gear 68.

Accordingly, plainly speaking, the document separation roller 14 rotates only when the motor 61 rotates in the positive (first) direction and the electromagnetic clutch 14*d* assumes its connected state, the register rollers 16 rotate whenever the motor 61 rotates in the reverse (second) direction, the document setting means 51 and rocking wings 52*b* of the document keep member 52 are operated in conjunction with the motor 61, and the discharge roller 36 rotates only when the motor 61 rotates in the positive direction.

To be more specific, although the illustrated drive unit 60 adopts the transmission component elements of the belts 62 and 65, pulleys 61*b*, 63*a*, 64*b* and 16*a*, and gears 63*b*, 64*a*, 16*b*, 67 and 68 for driving the drive shafts A14, A16, A36, A51 and A59, these component elements are not absolutely necessary to this document feeder. Thus, this invention does not contemplate imposing any limitation on the transmission component elements.

As is seen from the foregoing, with the document feeder according to this invention, by controlling the direction of rotation and the rotational speed of the variable-speed reversible motor 61 with prescribed timing, the original document can be reliably transferred efficiently in a rational manner if any number of documents exist or everywhere the document exists in the document passages p1, p2 and p3.

The principle of driving the component elements constituting the document supply unit 10, discharge unit 30, positioning unit 50 and drive unit 60 in the document feeder will be described with reference to the timing chart of FIG. 7 and the process diagrams of FIG. 8A through FIG. 8D. In FIGS. 8A to 8D, the respective interconnection of the drive shafts A14, A16, A36, A51 and A59 with the motor 61 is depicted by a solid line (working state) or a dotted line (resting state).

First of all, the document feeder assumes its operable state when the document sensor 13 detects the document or documents stacked on the document supply tray 11 in the state of switching on the copying machine (t1).

Figure 8A:
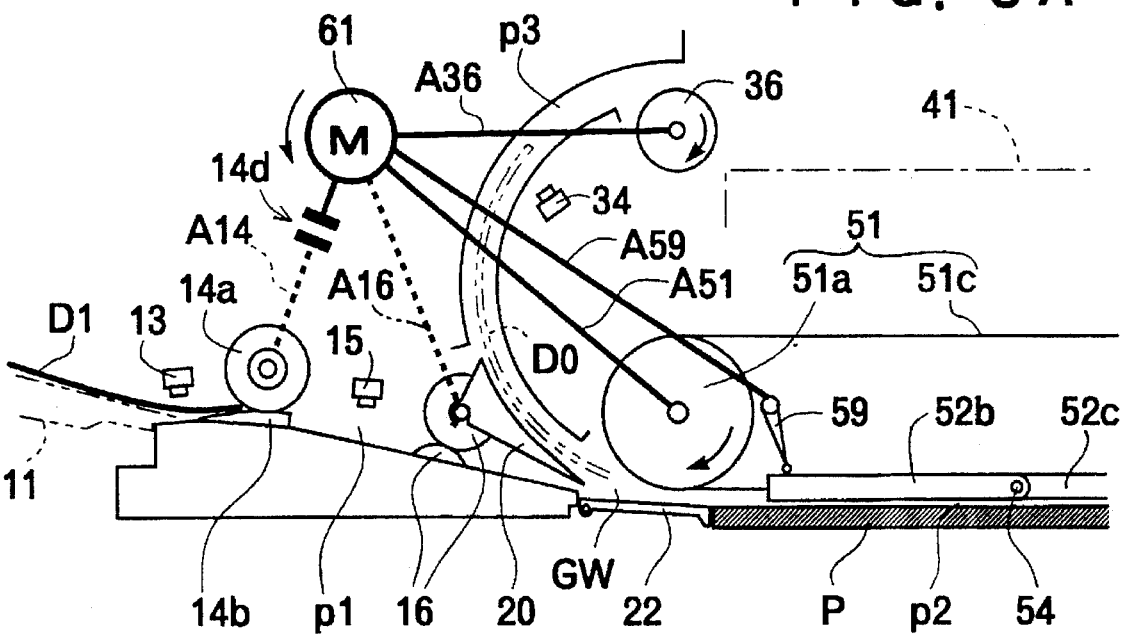
FIGS. 8A through 8D are explanatory diagrams showing the operating principle of the feeder of this invention.

When a copying switch of the copying machine is turned ON to issue to the feeder a command for transferring the document (t2), the motor 61 rotates at high speed in the positive (first) direction, thereby rotating the setting means 51 and the discharge roller 36 in the discharge direction opposite to the direction of rotation of the motor 61 as shown in FIG. 8A. At this time, the clutch 14*d* assumes its "DISCONNECT" state, so that the separation roller 14*a* is not yet rotated.

Figure 7:
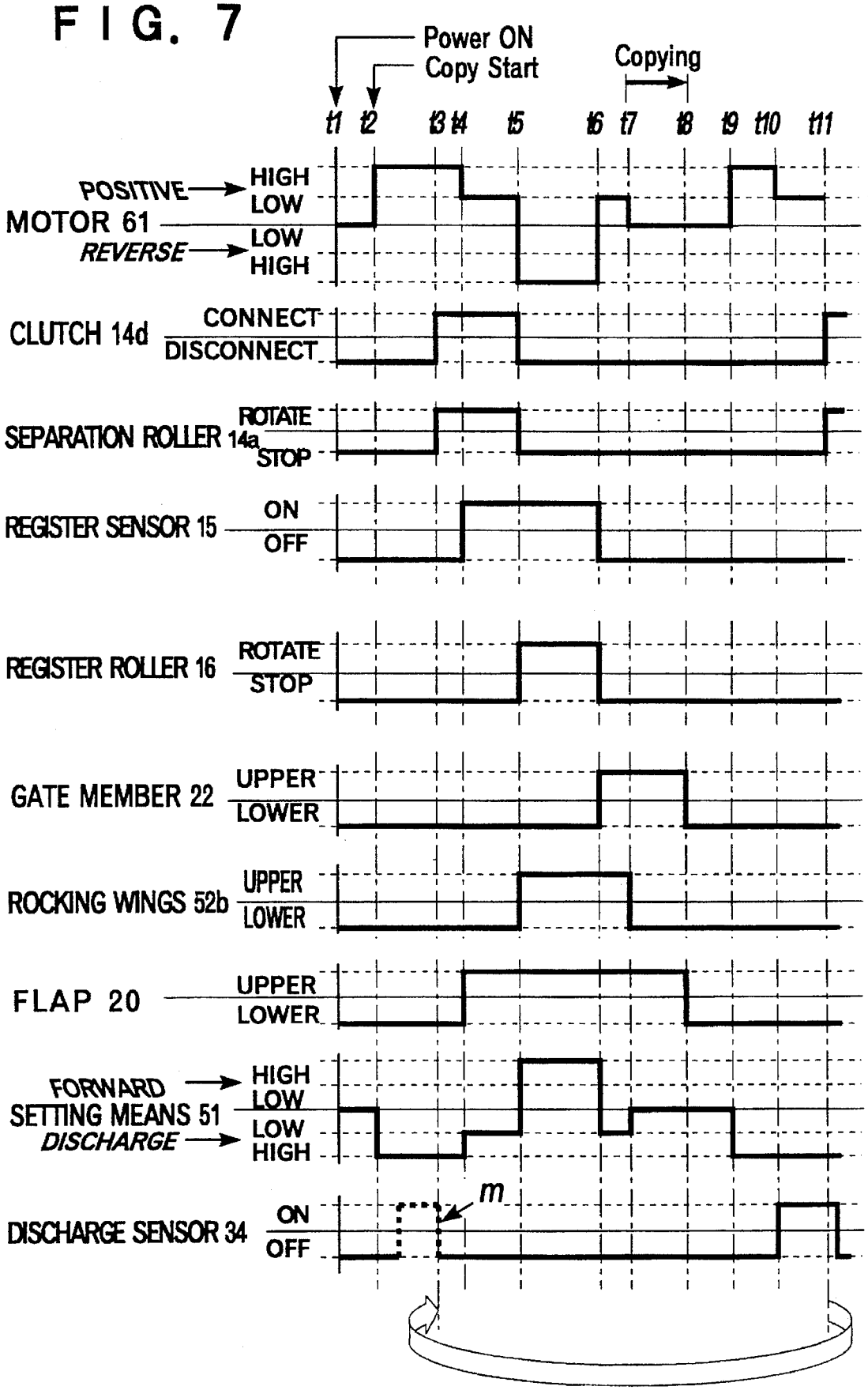
FIG. 7 is a timing chart of driving the moving components in the feeder of this invention.

If the discharge sensor 34 is turned ON while driving the setting means 51 as indicated by "m" in FIG. 7, a document D0 is deemed to exist in the discharge passage p3 as a consequence of leaving the document D0 behind or other possible cause as shown in FIG. 8A. In this case, the motor 61 continues rotating in the positive direction, while disengaging the clutch 14*d*, until the document DO is completely discharged to the discharge tray 41.

Figure 8B:
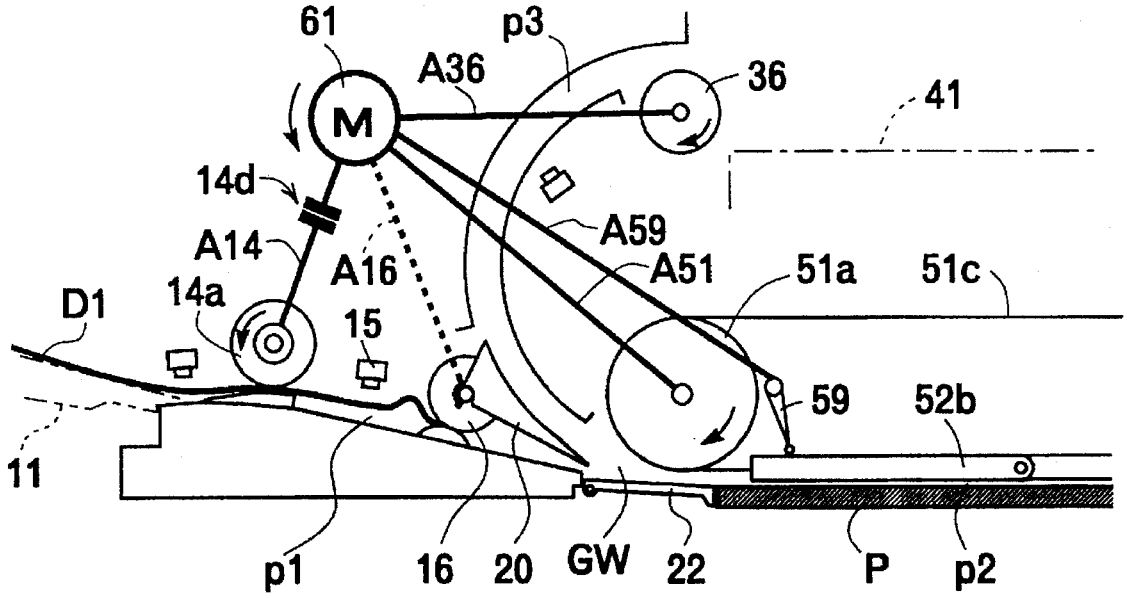

In a case that the discharge sensor 34 detects no document or when the document D0 left behind is sent out to the discharge tray 41, the clutch 14*d* is turned to its "CONNECT" state to rotate the separation roller 14*a* in the forward direction (t3), consequently to send out one document D1 from the document supply tray 11 toward the register rollers 16 at high speed as shown in FIG. 8B. Since the motor 61 rotates in the positive direction at this time, the register rollers 16 are not yet driven.

When the register sensor 15 detects the leading end of the document D1 being forwarded through the supply passage p1 (t4), the motor 61 decreases its rotational speed. In short, just before the document D1 collides with the register rollers 16, the document D1 slows down. As a result, the document D1 is forwarded at low speed until colliding with the register rollers 16. Then, the motor 61 continues rotating in the positive direction until the prescribed time (t4–t5) passes. That is, the register rollers 16 are kept at a stop until the document D1 is detected by the register sensor 15 and collides with the register rollers 16, thereby causing the document D1 to be slightly bent as illustrated in FIG. 8B, so as to carry out skew correction of the document D1.

Thus, since the document D1 is softly struck with the register rollers 16 by the motor 61 rotating at low speed, it is at no time damaged.

Figure 8C:
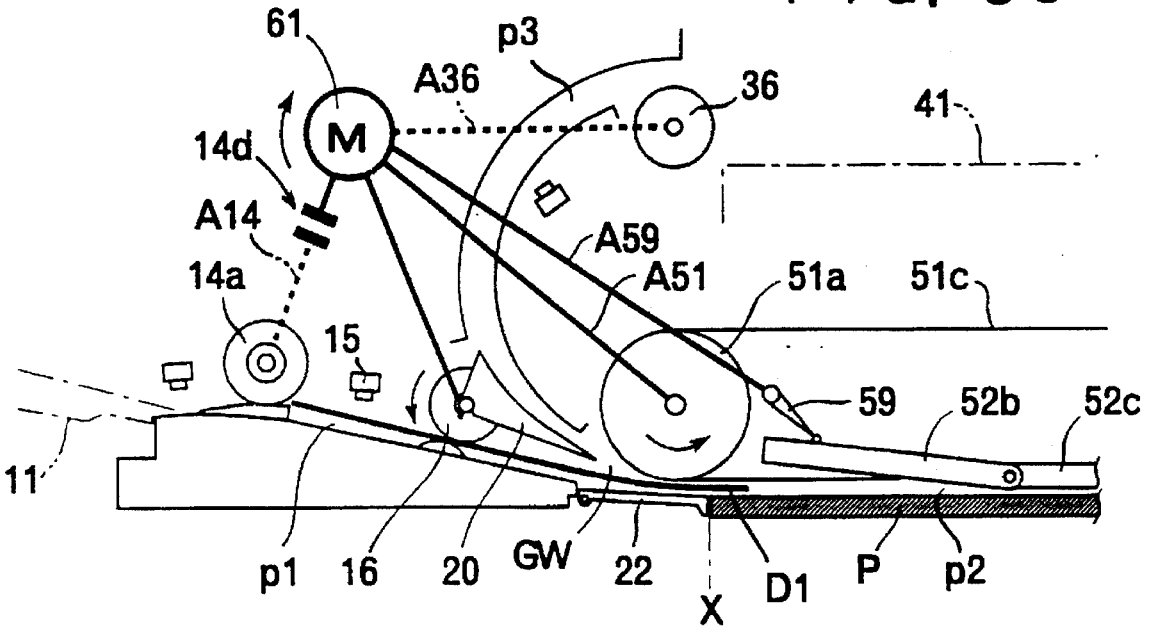

Just after the document D1 collides with the register rollers 16 (t5), the motor 61 is reversed and the clutch 14*d* for the separation roller 14*a* is disengaged. As a result, the separating roller 14*a* stops, and the register rollers 16 are rotated by rotating the motor 61 at high speed in the reverse (second) direction, thus introducing the document D1 into the document reading portion p2 through the gateway GW as shown in FIG. 8C. At this time, the flap 20 assumes its upper position, and the gate member 22 is lowered.

Figure 8D:
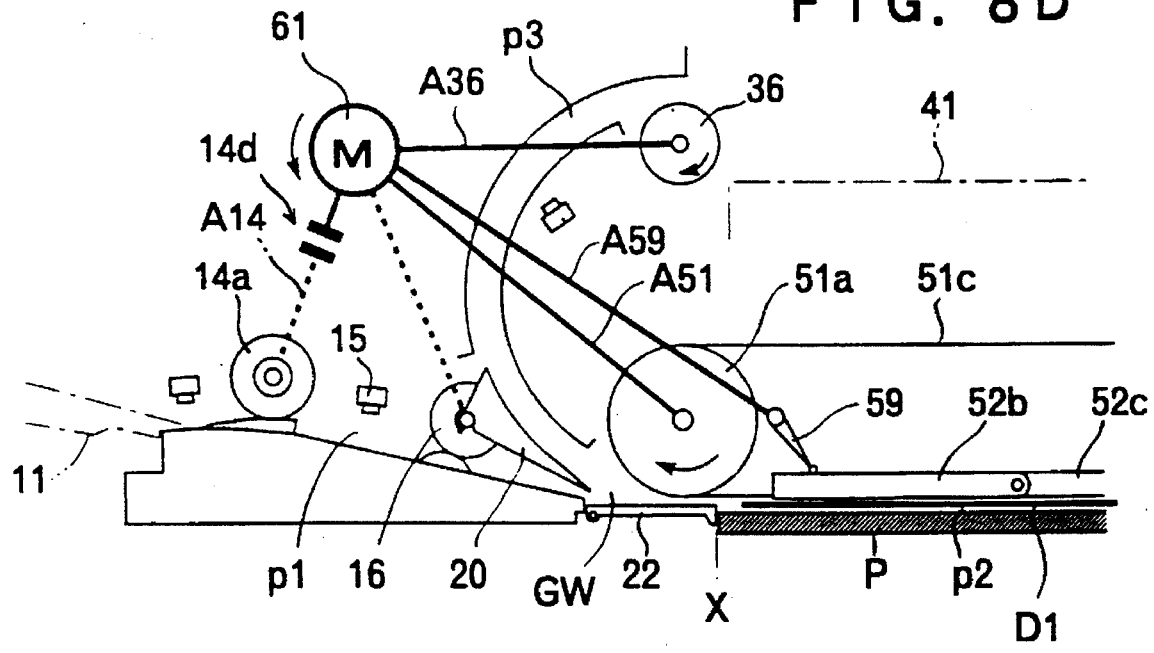

Thereafter, when the tail end of the document D1 sent into the the document reading portion p2 on the platen P passes through the document reading reference point X as shown in FIG. 8D, the direction of rotation of the motor 61 is changed to rotate the motor 61 in the positive (first) direction at low speed (t6). As a result, the setting means 51 is driven at low speed to slowly move the document D1 to the desired reading position. Namely, the slow rotation of the motor 61 continues until the tail end of the document D1 reaches the reading reference point X (t6–t7).

The movement of the document D1 transferred to the reading position on the platen P is managed by taking count of pulse signals of a driving current applied to the motor 61. That is, when the tail end of the document D1 is detected by the document sensor 15, counting of the pulses of the driving current is started, and then, when the pulses are counted up to a prescribed number which is determined so as to deliver the document D1 beyond the reading reference point X as shown in FIG. 8D, the motor 61 is reversed to move the document D1 backward by another prescribed number of pulses, thereby to precisely position the document D1 at the desired reading position.

At the time of reversing the motor 61 to rotate in the positive direction, the rocking wings 52*b* is lowered to press the document D1 against the platen P (t7).

When the document D1 arrives at the reading position, the motor 61 is stopped, and the desired document reading operation is carried out (t7–t8).

Upon completion of copying, the flap 20 and the gate member 22 are lowered (t8).

Then, the motor 61 is driven at high speed in the positive (first) direction, thus rotating the setting means 51 and the discharge roller 36 at high speed in the discharge direction (t9). When the discharge sensor 34 detects the document sent out from the reading portion p2 along the discharge passage p3 (t10), the motor 61 is turned to low speed. Consequently, the document is discharged onto the discharge tray 41 without experiencing a shock.

While the discharge sensor 34 detects the document passing along the discharge passage p3 (t9–t10), the setting means 51 and the discharge roller 36 continue to rotate.

Just after the discharge sensor 34 detects the document being discharged through the discharge passage p3, the document sensor 13 is worked to detect the following document on the supply tray 11 (t11). If the document exists on the tray 11, the succeeding operation of feeding the following document is repeated from t3. Namely, the clutch is turned to its "CONNECT" state while rotating the motor 61 in the positive (first) direction, so that the separation roller 14*a* is rotated to draw out one document from the document tray 11.

If no document is detected at t11, the feeding operation of the document feeder ceases.

As is apparent form the foregoing description, according to the present invention, the driving components constituting the document supply unit for sending one document toward the document reading position, the document positioning unit for placing the document fed from the document supply unit at the document reading position, and the document discharge unit for discharging the document from the document reading position can be effectively actuated merely by controlling only one variable-speed reversible motor in direction of rotation and rotational speed. Therefore, it becomes possible to rationally perform the document feeding operation and make the structure of the feeder simple, lightweight and compact. Besides, since the motor for driving the driving component elements of the feeder is controlled in rotational speed, the document can be transferred at high speed without being damaged.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is:

1. An automatic document feeder comprising:

a document supply unit including a document separation means for permitting one document to pass therethrough and sending the document toward a document reading portion, at least one pair of register rollers for performing skew correction of the document, and a document supply passage in which said document separation means and said register rollers are arranged;

a document positioning unit disposed on said document reading portion for positioning the document fed from said document separation means at said document reading portion;

a document discharge unit including a document discharge passage, and at least one discharge roller for discharging the document from said document reading portion through said document discharge passage, and a drive unit including a reversible motor for driving said document supply unit, document positioning unit and document discharge unit, said drive unit is driven at high speed to forward the document sent from said document separation means toward said register rollers at high speed, and slows down to forward the document at low speed until the document reaches the register rollers.

2. A document feeder according to claim 1, further comprising a discharge sensor disposed in said discharge passage, and wherein said drive unit is driven at high speed to forward the document sent along said discharge passage at high speed until said discharge sensor detects said document, and slows down to discharge said document at low speed when said discharge sensor detects said document.

3. An automatic document feeder comprising a document supply unit including a document separation means for permitting one document to pass therethrough and sending the document toward a document reading portion, at least one pair of register rollers for performing skew correction of the document, and a document supply passage in which said document separation means and said register rollers are arranged;

a document positioning unit disposed on said document reading portion for positioning the document fed from said document separation means at said document reading portion;

a document discharge unit including a document discharge passage, and at least one discharge roller for discharging the document from said document reading portion through said document discharge passage;

a drive unit including a reversible motor for driving said document supply unit, document positioning unit and document discharge unit; and a discharge sensor disposed in said discharge passage, and wherein said drive unit is driven at high speed to forward the document sent along said discharge passage at high speed until said discharge sensor detects said document, and slows down to discharge said document at low speed when said discharge sensor detects said document.

4. An automatic document feeder for feeding an original document to a document reading portion defined on a document handling device, which comprises:

a drive unit including a reversible driving motor capable of producing rotational motions in a first direction and a second direction opposite to the first direction;

a document supply unit including a document separation means selectively driven when driving said driving motor in the first direction so as to permit one document to pass therethrough and sending the document toward said document reading portion, a clutch disposed between said drive unit and said document separation means, at least one pair of register rollers driven when driving said driving motor in the second direction for performing skew correction of the document, and a document supply passage in which said document separation means and said register rollers are arranged;

a document positioning unit having document setting means disposed on said document reading portion and driven in concert with said driving motor for positioning the document fed from said document separation means at said document reading portion and discharging the document, and a document keep member having rocking wings disposed on either side of said document positioning unit and driven in concert with said driving motor so as to press the document placed on the document reading portion by driving said driving motor in said first direction; and a document discharge unit including a document discharge passage, and at least one discharge roller driven in concert with said driving motor for discharging the document from said document reading portion through said document discharge passage.

5. A document feeder according to claim 4, wherein said driving motor is driven in the first direction at high speed to forward the document sent from said document separation means toward said register rollers at high speed, and slows down to forward the document at low speed until the document reaches the register rollers.

6. A document feeder according to claim 5, further comprising a discharge sensor disposed in said discharge passage, and wherein said driving motor is driven at high speed to forward the document sent along said discharge passage at high speed until said discharge sensor detects said document, and slows down to discharge said document at low speed when said discharge sensor detects said document.

7. A document feeder according to claim 4, further comprising a discharge sensor disposed in said discharge passage, and wherein said driving motor is driven at high speed to forward the document sent along said discharge passage at high speed until said discharge sensor detects said document, and slows down to discharge said document at low speed when said discharge sensor detects said document.

8. An automatic document feeder for feeding at least one original document to a document reading portion defined on a document handling device, which comprises:

a drive unit including a variable-speed reversible driving motor capable of producing rotational motions in a first direction and a second direction opposite to the first direction;

a document supply tray for stacking said at least one document thereon;

a document supply unit including a document sensor for detecting the document on said document supply tray, a document separation means selectively driven when driving said driving motor in the first direction so as to permit one document to pass therethrough and sending the document toward said document reading portion, a clutch disposed between said drive unit and said document separation means, a register sensor for detecting the document fed through said separation means, at least one pair of register rollers driven when driving said driving motor in the second direction for performing skew correction of the document, and a document supply passage in which said document sensor, said document separation means, said register sensor and said register rollers are arranged in order;

a document positioning unit having document setting means disposed on said document reading portion and driven in concert with said driving motor for positioning the document fed from said document separation means at said document reading portion and discharging the document, and a document keep member having rocking wings disposed on either side of said document positioning unit and driven in concert with said driving motor so as to press the document placed on the document reading portion by driving said driving motor in said first direction;

a document discharge unit including a document discharge passage, a document discharge sensor for detecting the document being transferred along said document discharge passage, and at least one discharge roller driven in concert with said driving motor for discharging the document from said document reading portion through said document discharge passage; and a document discharge tray confronting said document discharge roller for receiving the document discharged from said document discharge unit.

9. A document feeder according to claim 8, wherein said document separation means is selectively driven with the rotational motion of said driving motor in the first direction and transmitted through said clutch when feeding the document.

10. A document feeder according to claim 8, wherein said driving motor is driven in the first direction at high speed to forward the document sent from said document separation means toward said register rollers at high speed, slows down to forward the document at low speed when said register sensor detects the document fed through said document separation means, and is reversed at regular intervals of time after said register sensor detects the document fed through said document separation means, thereby rotating said register rollers to transfer the document toward said document reading portion.

11. A document feeder according to claim 8, wherein said driving motor is driven at high speed to forward the document sent along said discharge passage at high speed until said discharge sensor detects said document, and slows down to discharge said document at low speed when said discharge sensor detects said document.

12. A document feeder according to claim 8, wherein said driving motor is driven in the first direction at high speed to forward the document sent from said document separation means toward said register rollers at high speed, slows down to forward the document at low speed when said register sensor detects the document fed through said document separation means, and is reversed at regular intervals of time after said register sensor detects the document fed through said document separation means, thereby rotating said register rollers to transfer the document toward said document reading portion, and wherein said driving motor is driven at high speed to forward the document sent along said discharge passage at high speed until said discharge sensor detects said document, and slows down to discharge said document at low speed when said discharge sensor detects said document.

13. A document feeder according to claim 8, wherein said rocking wings are connected to said drive unit via a friction clutch.

14. An automatic document feeder for feeding at least one original document to a document reading portion defined on a document handling device, which comprises:

a drive unit including a variable-speed reversible driving motor capable of producing rotational motions in a first direction and a second direction opposite to the first direction;

a document supply tray for stacking said at least one document;

a document supply unit including a document sensor for detecting the document on said document supply tray, a document separation means formed of a document separation roller and a friction pad being in contact with said document separation roller, said document separation roller being selectively driven when driving said driving motor in the first direction so as to permit one document to pass therethrough and sending the document toward said document reading portion, a clutch disposed between said drive unit and said document separation means, a register sensor for detecting the document fed through said separation means, at least one pair of register rollers driven when driving said driving motor in the second direction for performing skew correction of the document, and a document supply passage in which said document sensor, said document separation means, said register sensor and said register rollers are arranged in order;

a document positioning unit having document setting means disposed on said document reading portion and driven in concert with said driving motor for positioning the document fed from said document separation means at said document reading portion and discharging the document, and a document keep member laid on said document reading portion and having rocking wings disposed on either side of said document positioning unit and driven in concert with said driving motor so as to press the document placed on the document reading portion by driving said driving motor in said first direction;

a document discharge unit including a document discharge passage, a document discharge sensor for detecting the document being transferred along said document discharge passage, and at least one discharge roller driven in concert with said driving motor for discharging the document from said document reading portion through said document discharge passage;

a switching flap disposed among said document supply passage, document reading portion and document discharge passage, and a document discharge tray confronting said document discharge roller for receiving the document discharged from said document discharge unit, said driving motor being driven in the first direction at high speed to forward the document sent from said document separation means toward said register rollers at high speed, slows down to forward the document at low speed when said register sensor detects the document fed through said document separation means, and is reversed at regular intervals of time after said register sensor detects the document fed through said document separation means, thereby rotating said register rollers to transfer the document toward said document reading portion, and said driving motor being driven at high speed to forward the document sent along said discharge passage at high speed until said discharge sensor detects said document, and slows down to discharge said document at low speed when said discharge sensor detects said document.

15. A document feeder according to claim 14, wherein said rocking wings are connected to said drive unit via a friction clutch.

16. A document feeder according to claim 14, wherein said document discharge tray is located above said document keep member.

* * * * *